United States Patent [19]

Sykora

[11] Patent Number: 4,495,999

[45] **Date of Patent: * Jan. 29, 1985**

[54] DEEP WATER HYDROSTATIC HEAD CONTROL

[76] Inventor: James H. Sykora, P.O. Box 64677, Baton Rouge, La. 70896

[ * ] Notice: The portion of the term of this patent subsequent to Jan. 24, 2001 has been disclaimed.

[21] Appl. No.: 553,772

[22] Filed: Nov. 21, 1983

Related U.S. Application Data

[63] Continuation-in-part of Ser. No. 376,409, May 10, 1982, Pat. No. 4,427,073.

[51] Int. Cl.[3] ..... E21B 43/01

[52] U.S. Cl. ..... 166/364

[58] Field of Search ..... 166/363, 364, 362, 368

[56] References Cited

U.S. PATENT DOCUMENTS

| | | | |
|---|---|---|---|
| 2,109,251 | 2/1938 | Jacobson | 137/893 X |
| 3,201,049 | 8/1965 | Hayes | 137/893 X |
| 4,046,191 | 9/1977 | Neath | 166/352 |
| 4,186,772 | 2/1980 | Handleman | 137/891 |
| 4,310,050 | 1/1982 | Bourgoyne | 175/48 X |
| 4,310,058 | 1/1982 | Bourgoyne | 175/48 |
| 4,320,541 | 3/1982 | Neenan | 137/892 X |
| 4,427,073 | 1/1984 | Sykora | 166/364 |

*Primary Examiner*—Stephen J. Novosad
*Assistant Examiner*—Michael Starinsky
*Attorney, Agent, or Firm*—William David Kiesel; Robert C. Tucker

[57] ABSTRACT

Hydrostatic head control in the marine riser or sub-sea BOP stack of a deep water drilling unit is maintained through use of an eductor, or similar means, connected to the sub-sea BOP stack kill line for drawing salt water from the sea or mud from the sub-sea BOP stack choke line.

2 Claims, 2 Drawing Figures

DEEP WATER HYDROSTATIC HEAD CONTROL

RELATED APPLICATIONS

This is a continuation-in-part application of U.S. patent application Ser. No. 06/376,409 filed May 10, 1982 by the inventor herein, and entitled "Deep Water Hydrostatic Head Choke" (now U.S. Pat. No. 4,427,073), specific mention whereof is made to obtain benefit of its filing date.

BACKGROUND OF THE INVENTION

1. Field of the Invention

This invention relates to deep water drilling, and more particularly to apparatus and proceses for maintaining hydrostatic head control during such drilling.

2. Prior Art

Present day drill ships and semi-submersible drilling rigs are designed to operate in water up to 6000 feet and actual wells already have been drilled in over 4000 feet of water. Because much of the untapped oil reserves lies in such deep water it is expected that deep water drilling shall continue to become more common.

Both for safety and environmental control it is necessary to use a blow-out preventer (BOP) stack. When drilling at these depths it is desirable and in fact is the common practice to position the BOP stack near or on the sea floor. An example of such a drilling arrangement is illustrated in Cameron Iron Works, Inc.'s brochure entitled "A Marine Drilling & Control Package By Cameron Iron Works." Examples of other marine riser assemblies can be seen in U.S. de Saint Palais, et al U.S. Pat. No. 4,058,137 issued Nov. 15, 1977 and entitled "Riser Pipe for Pivotally attached Structure Used to Extract Petroleum from Beneath a Body of Water;" U.S. Jones Patent U.S. Pat. No. 4,078,605 issued Mar. 14, 1978 and entitled "Riser Pipe String;" U.S. Osborne Patent U.S. Pat. No. 4,130,995 issued Dec. 26, 1978 and entitled "VMP Riser Horizontal Bearing;" and U.S. Rohde Patent U.S. Pat. No. 4,214,843 and entitled "Subsea Grout Distributer." Because of the high pressure, it is preferable that only small ($2\frac{1}{2}''$ to $4\frac{1}{2}''$ diameter) choke and kill lines be used. Unfortunately, this creates problems in maintaining hydrostatic head during gas kicks. In these situations gas bubbles begin to rapidly elongate when they reach the small choke line and can quickly empty the choke line of all drilling mud resulting in loss of the hydrostatic head. This is also true when utilizing the marine riser for returns of gas to surface.

SUMMARY OF THE INVENTION

Therefore it is an object of this invention to provide means for maintaining hydrostatic head in a sub-sea marine riser and choke or kill lines during as kicks.

Another object is to provide such a means which can be easily attached to present marine risers, BOP stacks' kill or choke lines.

Still another object is to provide a device which will qickly break up gas bubbles in the BOP stack choke lines or marine riser.

These and other advantages and objects of this invention shall become apparent from the ensuing descriptions of the invention.

Accordingly, in a conventional marine riser BOP stack assembly having multiple rams, a kill line and a choke line, an eductor is attached to either line so as to receive the gas bubbles at its intake end, and having its suction end openable directly to the sea water. In an alternate embodiment the eductor is attached to the choke line with its suction end connected and openable to receive drilling mud from the kill line. In still another embodiment, the eductor is connected to the marine riser and having its section end attached to receive either sea water or drilling mud from the kill line.

PREFERRED EMBODIMENTS OF THE INVENTION

Figure 1:
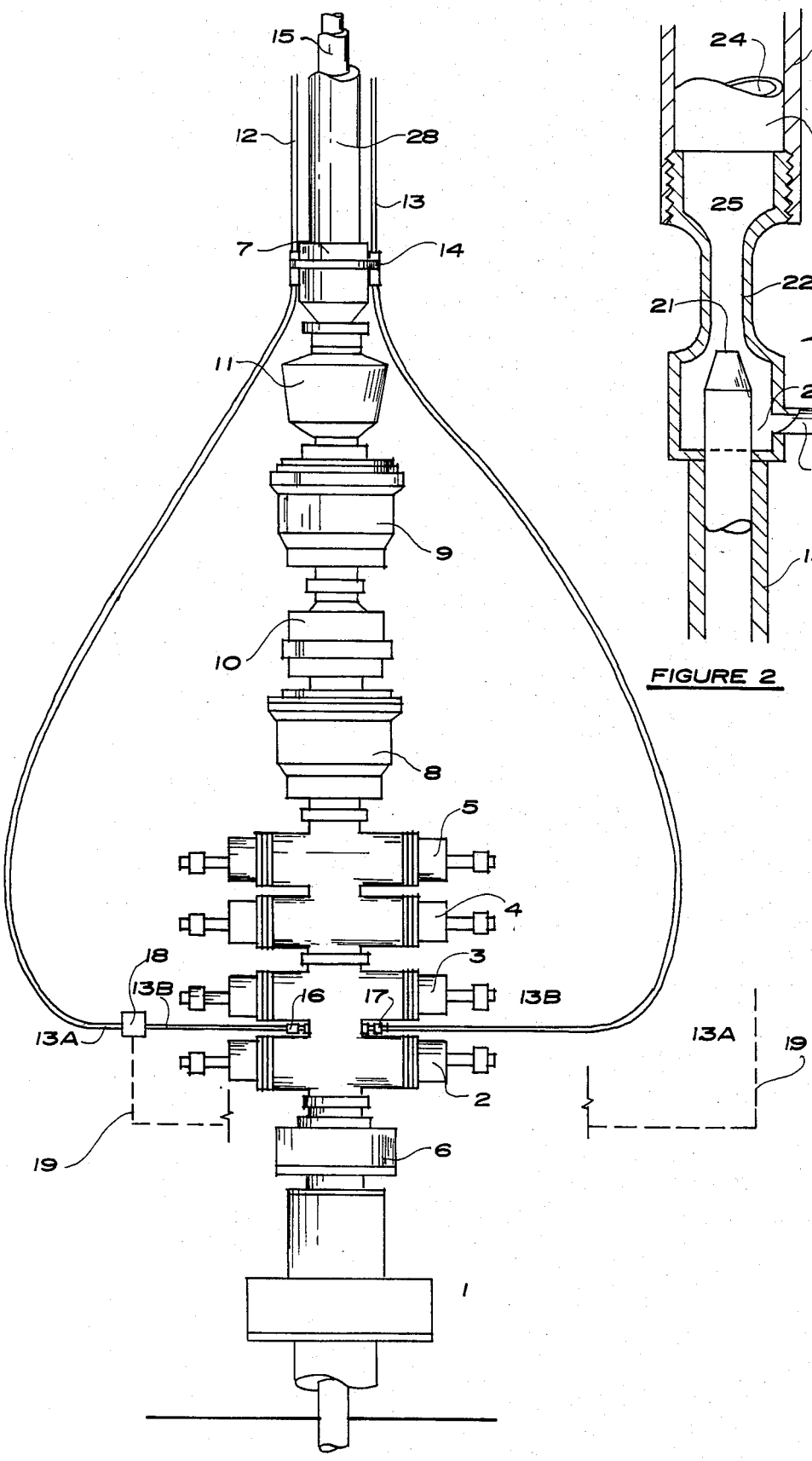
FIG. 1 is a schematic drawing of a preferred embodiment of a BOP stack utilizing an eductor of this invention.

Referring now to FIG. 1, a preferred embodiment of a BOP stack according to this invention is disclosed comprising a well head assembly 1 to which a series of conventional undersea hydraulic rams 2, 3, 4 and 5 are attached by means of a collet or well head connector 6. It is also preferred that connecting ram 5 and riser adapter 7 is a conventional series of annular preventers 8 and 9 and by a riser connecter 10 and ball joint 11 as shown. In this embodiment kill line 12 and choke line 13 extend downward from the drilling ship (not shown) where they attach and are secured by clamp 14 to riser adapter 7 and then extend to connect into drill pipe 15 between rams 2 and 3.

To control flow of materials from lines 12 and 13 into drill pipe 15 or marine riser 28, valves 16 and 17, respectively, which can be hydraulically controlled from the drill ship by hydraulic lines (not shown), are positioned in lines 12 and 13 as shown. In a preferred embodiment eductor 18 is attached to kill line 12 at sections 13A and 13B to allow salt water or in the alternative mud from choke line 13 by line 19 to enter kill line 12 as explained below.

Figure 2:
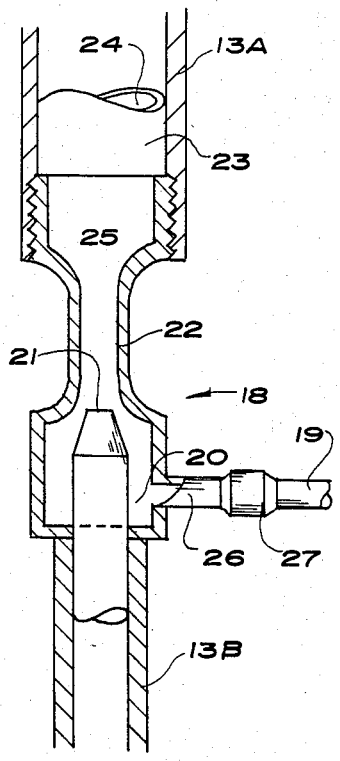
FIG. 2 is a three-dimensional cutaway of a preferred embodiment of the eductor used with the BOP stack.

Turning now to FIG. 2, a preferred embodiment of eductor 18 is shown. Eductor 18 comprises an inlet section 20 with inlet opening 21, a venturi section 22, a discharge section 23 with discharge opening 24 which define a passageway 25 through which fluids can pass. Eductor 18 also comprises a secondary fluid section 26 for receiving salt water or drilling mud from line 19. positioned as shown to control the flow of the salt water into passageway 25.

In operation, kick gas enters passageway 25 through inlet opening 21 and acts as the motive force to draw sea water from the sea floor area and through valve 27 to break up the gas bubbles in passageway 25 thus reducing the violence of the kick gas bubbles and preventing the mud in kill line 12 from being blown out. Hence, the hydrostatic head can be controlled and maintained.

One of the benefits of the apparatus is that at deep depths the water pressure is sufficient to force sufficient salt water into eductor 18 without additional equipment. As an alternate to the use of eductor an in-line turbine pump could be used to wherein the kick gas would be used as the motive power.

It is also noted that the eductor can be used as a means of fire suppression on a surface installation when installed downstream of the surface choke and the mud-gas separator. In this case either drilling mud or Halone could be injected into the gas stream by the eductor.

There are of course many obvious alternate embodiments to the invention not specifically mentioned but which are intended to be included within the scope of the invention as defined by the following claims.

What I claim is:

1. In a marine riser and BOP stack assembly positioned near the bottom of a water body and having multiple rams, a kill line and a choke line, the improvement to which comprises connecting an eductor to said kill line to receive any kick gas from said assembly through an eductor intake opening wherein said eductor comprises a suction end openable to said water body to allow water to mix with said kick gas in said eductor.

2. In a marine riser and BOP stack assembly according to claim 1 wherein said suction end is openable to said choke line.

* * * * *